US005810212A

United States Patent [19]

Santagiuliana

[11] Patent Number: 5,810,212

[45] Date of Patent: Sep. 22, 1998

[54] CAP WITH INTERCHANGEABLE DISPENSER

[75] Inventor: Evans Santagiuliana, Vicenza, Italy

[73] Assignee: Taplast Spa, Dueville, Italy

[21] Appl. No.: 716,381

[22] PCT Filed: Mar. 21, 1995

[86] PCT No.: PCT/EP95/01047

§ 371 Date: Sep. 19, 1996

§ 102(e) Date: Sep. 19, 1996

[87] PCT Pub. No.: WO95/25677

PCT Pub. Date: Sep. 28, 1995

[30] Foreign Application Priority Data

Mar. 23, 1994 [IT] Italy ..... VI94A0043

[51] Int. Cl.[6] ..... B65D 25/48; B65D 47/08

[52] U.S. Cl. ..... 222/546; 215/237; 215/319; 222/570

[58] Field of Search ..... 222/546, 482, 222/556, 567, 570, 562; 215/237, 319

[56] References Cited

U.S. PATENT DOCUMENTS

| | | | |
|---|---|---|---|
| 3,240,405 | 3/1966 | Abbott | 222/546 X |
| 3,655,102 | 4/1972 | Moran | 222/546 X |
| 3,850,341 | 11/1974 | Bart | 215/319 X |
| 3,980,211 | 9/1976 | Owens | 222/562 X |
| 4,895,282 | 1/1990 | Robinson | 222/546 X |
| 5,169,035 | 12/1992 | Imbery, Jr. | 222/546 X |

FOREIGN PATENT DOCUMENTS

| | | |
|---|---|---|
| 0538573 | 4/1993 | European Pat. Off. . |
| 1021166 | 2/1953 | France . |
| 2104811 | 2/1971 | Germany . |
| 2076378 | 12/1981 | United Kingdom . |
| 2193193 | 2/1988 | United Kingdom . |

*Primary Examiner*—Kevin P. Shaver

*Attorney, Agent, or Firm*—Watson Cole Grindle Watson P.L.L.C.

[57] ABSTRACT

A cap for containers, which includes: a collar (2) with a substantially central through hole (20) in which is movably connected, a dispenser (3; 7; 8; 9) provided with a dispensing pipe (63; 73; 83; 93) and with a cover (4). The cover presents at least two sealing elements (41; 42) each one of which is suitable for coupling with sealing effect with the dispensing pipe (63; 73; 83; 93) applied to the collar.

6 Claims, 2 Drawing Sheets

Fig. 1.
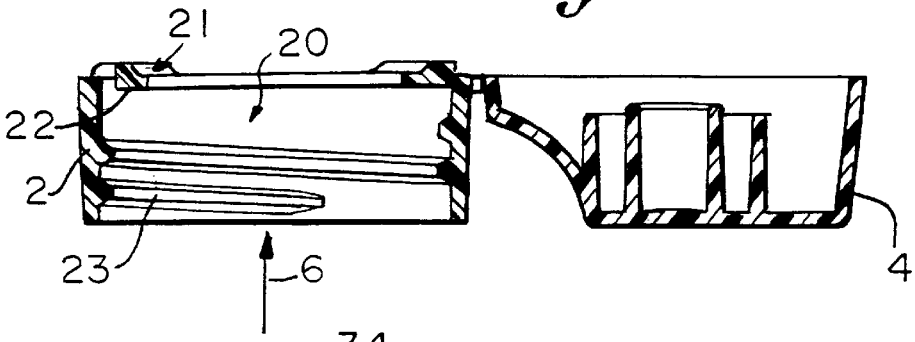
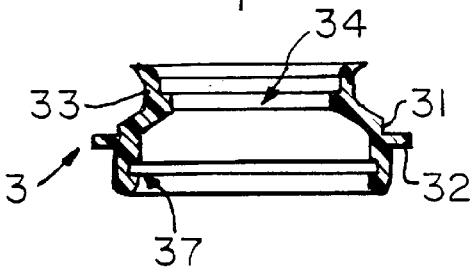
Fig. 2.
Fig. 3.
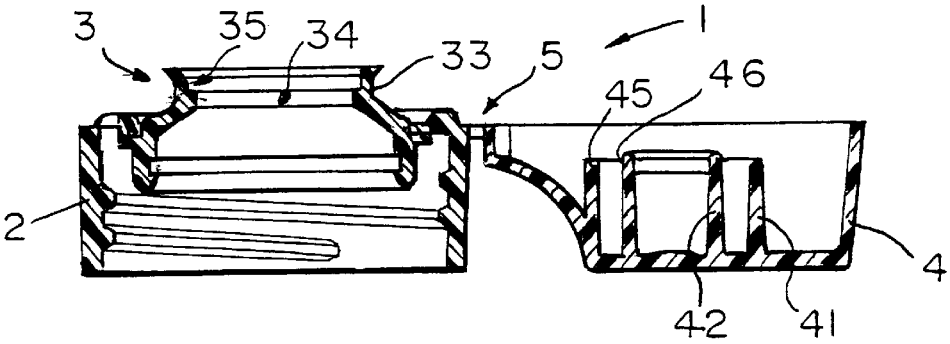
Fig. 4.
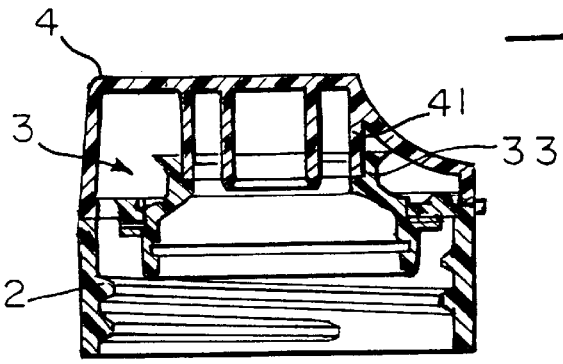

CAP WITH INTERCHANGEABLE DISPENSER

The invention relates to a cap with interchangeable dispenser, particularly suitable for being applied to containers for cosmetics, detergents and the like.

It is known that cosmetics like creams and lotions or detergents like shampoos, bath foams, cleansing agents, liquids for domestic use and the like are sold in containers that are closed by means of dispensing pumps. Said dispensers are provided with a dispensing pipe and are characterized by different shapes and dispensing diameters, depending on the product to be dispensed or to the use it is meant for.

Therefore, for example, if the product to be dispensed is creamy, like a bath foam or a lotion, the dispenser will be provided with a pipe with a circular dispensing outlet that can be large or small depending on the density of the product itself, while if the product to be dispensed is, for example, a liquid for domestic use, the dispenser will be preferably provided with a spray dispensing pipe, and so on.

Each of said caps, independently of the kind of dispenser it is provided with, is closed with a cover that generally makes up a single body with the cap itself, which is provided with a sealing element coupling with the dispensing pipe of the dispenser, thus intercepting its dispensing outlet.

It is easy to understand, therefore, that the cover of the cap must be provided with a sealing element the shape of which varies according to the shape of the dispensing pipe the dispenser is equipped with. Document DE-A-2104811 discloses a cap with a dispenser movably connected with a collar of said cap wherein the cover of said cap is provided with two sealings elements. If the shape of the dispenser changes, also the cap and the sealing elements must be changed.

Document U.S. Pat. No. 4,895,282 discloses a cap with a cover provided with a sealing elements wherein the dispenser is part of the cap and therefore can't be removed and changed with other dispenser. Therefore, the manufacturer must produce different caps according to the different profiles of the dispensing pipes with which the dispenser is provided, with the drawback of having to keep in stock considerable number of particulars in more variants.

Another drawback is represented by the fact that the manufacturer must also have a high number of molds.

It is obvious that such a high number of equipment and of articles to be kept in stock inevitably results in another inconvenience, that is, the rise in management costs.

The present invention is aimed at eliminating the above mentioned drawbacks.

In particular, the aim of the invention is the implementation of a cap suitable for being fitted with different dispensers, each one provided with a different dispensing pipe according to the needs and requirements of the customer.

The above mentioned goal is achieved through the implementation of an improved cap for containers, which, according to the main claim, comprises:

- a collar provided with elements for the connection with the neck of a container and with a substantially central through hole;
- a dispenser that can be moved and introduced into said substantially central hole of said collar by means of connecting elements and provided with a dispensing pipe with dispensing outlet communicating with the inside of said container;
- a cover provided with elements for the connection with said collar and with at least two sealing elements for sealing said dispensing outlet of said dispensing pipe, characterized in that said dispenser is interchangeable and in that at least one annular sealing elements cooperates with only one corresponding profile belonging to the dispenser outlet when the dispensing pipe belonging to the dispenser is applied to said collar.

According to a practical application of the invention in question the cover of said cap has two sealing elements consisting of two rings with circular section, coaxial with each other and positioned one inside the other, which are an integral part of the body of the cover itself.

Depending on the profile of the dispensing pipe with which the dispenser is provided, when the cover is closed either of said sealing elements units couples with the corresponding dispensing pipe in order to prevent the product from flowing out of the container if this is overturned.

To the manufacturer's advantage, a single type of cap can satisfy the needs of different customers, since, according to the requirements, it is possible to apply dispensers provided with different dispensing pipes to the same cap.

Further, another important aspect is the fact that this makes it possible to have fewer particulars and limited equipment, thus ensuring a considerable economic advantage.

The aims and the advantages mentioned above will be better highlighted through the description of one practical application among many of the invention in question, illustrated in the attached tables.

FIG. 1 shows the cap object of the invention without dispenser;

FIG. 2 shows a dispenser suitable for coupling with the cap shown in FIG. 1;

FIG. 3 shows the cap fitted with the dispenser shown in FIG. 2 and with open cover;

FIG. 4 shows the cap shown in FIG. 3 with closed cover;

Figure 9:
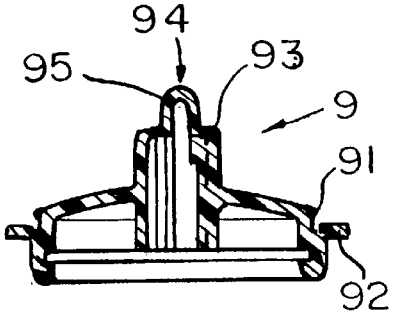
FIG. 9 shows another executive variant of the dispenser.

As FIG. 3 shows, the cap 1 object of the invention comprises a collar 2 provided with a threading 23 for the connection with the neck of a container that isn't represented in the figure, a dispenser 3 that can be moved and applied to said collar 2 and a cover 4 connected with the collar 2 itself by means of a hinge element 5.

It is important to specify that the collar 2, in its different practical applications, can be provided with systems for the connection with the neck of the container that are different from the threading and that can consist of snap elements and the like.

In FIG. 2 it can be observed, in particular, that said dispenser 3 is provided with a coupling edge 31 and with a shoulder 32, both protruding with respect to the body of the dispenser itself, and has also a dispensing pipe 33 in which a dispensing outlet 34 has been obtained to pour the product from the container to which the cap is applied.

The presence of the coupling edge 31 and of the shoulder 32 in the dispenser makes it possible to move the dispenser and introduce it into a through hole 20, which, as shown in FIG. 2, is coaxial and central to the collar 2.

This coupling takes place when, forcing the dispenser 3 in the direction 6 against the collar 2, its shoulder 32 strikes against the internal annular zone 22 of the hole 20 and at the same time the coupling edge 31 of the dispenser 3 is released against the external perimetric zone 21 of the hole 20 itself.

As far as the cover 4 is concerned, it can be observed in FIG. 3 that it is provided with a first sealing element 41, which serves to intercept the dispensing outlet 34 of the dispenser 3, in such a way as to prevent the product from flowing out of the container.

In fact, when the cover 4 is closed, as shown in FIG. 4, said first sealing elements 41 couples with said dispensing pipe 33 by fitting in the seat 35 obtained in the outlet 34 of the dispenser 3, thus ensuring its sealing.

Figure 7:
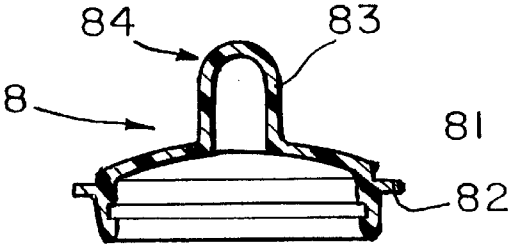
FIG. 7 shows another executive variant of the dispenser.
Figure 5:
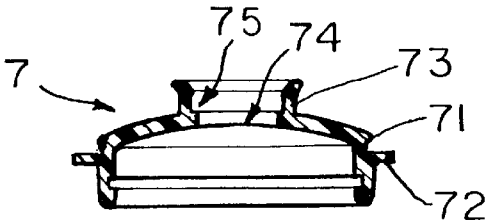
FIG. 5 shows an executive variant of the dispenser.

It is possible to couple in the hole 20 of the collar also dispensers provided with dispensing pipes characterized by different profiles, like for example the dispensers 7, 8 and 9 represented in the FIGS. 5, 7 and 9, respectively.

This is possible because any of said dispensers is provided with a coupling edge 71, 81 and 91, respectively, suitable for coupling by snapping against the external perimetric zone 21 of the hole 20 and with a shoulder 72, 82 and 92, respectively, suitable for coupling with the internal annular zone 22 of the hole 20, but above all because the cover 4 of the cap has also a second sealing element 42 placed coaxially inside the first sealing element 41.

Also said second clogging unit 42 has, like the first sealing element 41, a tubular shape with circular transversal section, the profile of which is suitable for coupling with the profile of the dispensing pipe of the dispenser the cap is fitted with.

Figure 6:
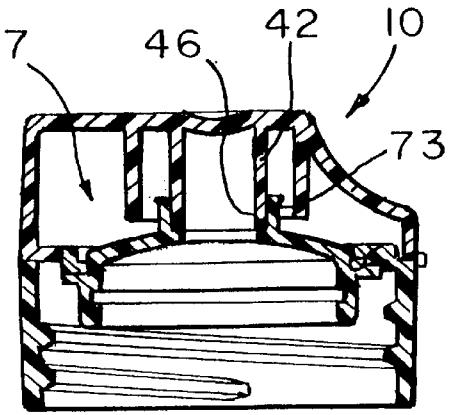
FIG. 6 shows the cap object of the invention with closed cover and provided with the dispenser shown in FIG. 5.

Thus, for example, as shown in FIG. 6, if the cap, referred to as a whole by 10, is provided with the dispenser 7 shown in FIG. 5, said second sealing element 42 couples with the dispensing pipe 73 of the dispenser 7 itself, since the terminal edge 46 of the sealing element gets into the dispensing outlet 74 and couples with the dispensing pipe 73 striking against the seat 75.

Figure 8:
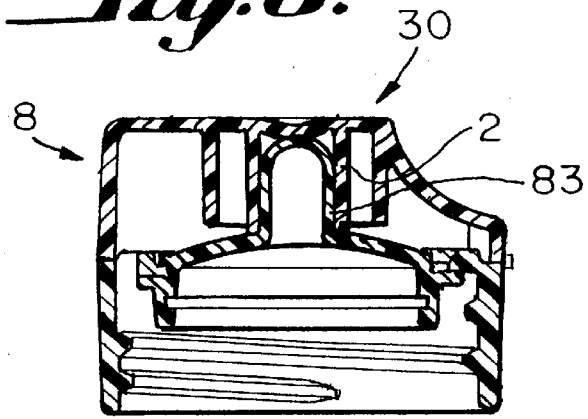
FIG. 8 shows the cap object of the invention with closed cover and provided with the dispenser shown in FIG. 7.

If, as shown in FIG. 8, the cap 30 is provided with the dispenser 8 represented in FIG. 7, the dispensing pipe 83 of which has a lateral spraying outlet 84, when the cover is closed the dispensing outlet 84 is intercepted by the coupling of the dispensing pipe 83 inside the second sealing element 42.

Figure 10:
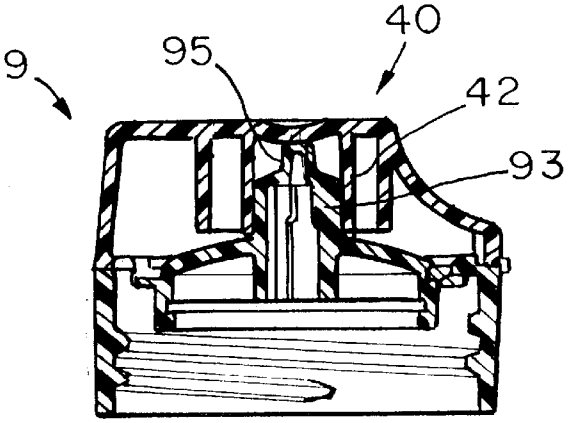
FIG. 10 shows the cap object of the invention with closed cover and provided with the dispenser shown in FIG. 9.

Finally, if, as shown in FIG. 10, the cap 40 is coupled with the dispenser 9 shown in FIG. 9, provided with a dispensing pipe 93 with seal 95 and with straight spraying outlet 94, the sealing of said dispensing outlet 94 takes place also in this case through the coupling of the dispensing pipe 93 inside the second sealing element 42.

According to the above description, therefore, it is clear that all the aims of the invention have been achieved through the implementation of the cap object of the invention.

Above all, it is possible to implement a single cap to which different dispensers satisfying the varying needs of different customers are fitted.

Further, said different dispensers can be sealed with a single kind of cover that presents sealing elements suitable for coupling with the dispensing pipe of any dispenser.

This results in a smaller number of articles to be kept in stock and in limited production equipment, with consequent savings in production costs.

It is evident that different executive variants can be obtained by applying different kinds of dispensers to the cap object of the invention.

Further, the collar of the cap can be provided with elements for the connection with the container, carried out in shapes different from those described.

The cap and the dispensers applied to it can be carried out with shapes and sizes different from those described, which however are to be considered as completely protected by the invention in question.

I claim:

1. A cap for connection with a neck of a container comprising:

a collar formed with a substantially central through opening;

at least one dispenser interchangeably connected in the opening of said collar and formed with a correspondingly sized dispensing outlet for communicating with interior of said container; and a cover connected with said collar and formed with at least two annular inner and outer sealing elements, the sized for sealably engaging a correspondingly sized dispensing outlet of said at least one dispenser, so that each annular sealing element cooperates only with the dispensing outlet sized therefore when the cover is closed.

2. The cap according to claim 1 wherein the at least one dispensers is formed with a central dispenser pipe having an opening, said dispenser pipe for engaging an interior of said inner annular sealing element.

3. The cap according to claim 1 wherein the at least one dispenser is formed with an enlarged central opening for engaging an exterior portion of said outer sealing element.

4. The cap according to claim 1 wherein said at least one dispenser and collar include means for coupling the dispenser into the opening of the collar.

5. The cap according to claim 4 wherein the means for connecting the dispenser and the collar includes a snap-fitting ridge formed in the opening and a corresponding detent formed in an outer surface of the dispenser.

6. The cap according to claim 5 wherein said means for connecting the dispenser with the collar further comprises a radially extending annular stopping surface extending from the dispenser and an inner surface portion of the collar for receiving the annular portion in abutment thereagainst when the ridge is engaged with the detent.

* * * * *